US005297368A

United States Patent [19]

Okada

[11] Patent Number: 5,297,368

[45] Date of Patent: Mar. 29, 1994

[54] MOVABLE WALL SYSTEM

[76] Inventor: Paul M. Okada, 12670 E. 132nd Ave., Brighton, Colo. 80601

[21] Appl. No.: 881,334

[22] Filed: May 11, 1992

[51] Int. Cl.[5] ..... E04B 2/82

[52] U.S. Cl. ..... 52/64; 52/109

[58] Field of Search ..... 52/64, 1, 27, 29, 109

[56] References Cited

U.S. PATENT DOCUMENTS

| | | | |
|---|---|---|---|
| 1,403,043 | 10/1912 | Carter | 52/64 X |
| 3,526,066 | 9/1970 | Hagar et al. | 52/64 |
| 4,635,729 | 1/1987 | Harmathy | 52/64 X |
| 4,667,692 | 5/1987 | Tury | 52/109 X |
| 4,716,693 | 1/1988 | Webster | 52/64 |
| 4,829,726 | 5/1989 | de Potter d'Indoye | 52/64 X |
| 4,841,689 | 6/1989 | Schussler | 52/64 X |
| 4,844,109 | 7/1989 | Navarro | 52/109 X |

*Primary Examiner*—Carl D. Friedman
*Assistant Examiner*—Beth A. Aubrey
*Attorney, Agent, or Firm*—Fields, Lewis, Pittenger & Rost

[57] ABSTRACT

A movable wall system for athletic courts makes the same court suitable for both racquetball, handball and squash play. The system disclosed includes a movable wall assembly between the front wall and back support structure at the back. Extensible and retractable side linkage assemblies connect between the movable wall assembly and back support structure that will stabilize the wall during movement. Side rollers and bottom rollers on the wall assembly facilitate sliding movement. Slide bolt catches hold the wall against movement in either the retracted or extended positions and latching mechanisms hold the wall assembly to the back wall in the retracted position.

19 Claims, 4 Drawing Sheets

MOVABLE WALL SYSTEM

TECHNICAL FIELD

This invention relates to movable walls and more particularly to a novel and improved movable wall system that is particularly suitable for using the same back wall for both racquetball/handball courts and squash courts.

BACKGROUND ART

The distance the back wall is from the front wall of a squash court and racquetball/handball courts differ. The back wall is spaced at 40 feet from the front wall for a racquetball/handball court and 32 feet for a squash court. In the past, separate rooms were required to play both games. The present invention allows the same court to be used for either playing racquetball/handball or squash by allowing the back wall to be moved to one of two set positions.

Prior attempts to provide a movable wall system for athletic courts have utilized tracks and/or grooves in the wall which is costly and impairs the game to some extent. Another system utilizes A-frames at the base of a movable wall but the movable wall is not stable and tends to tip over during movement.

DISCLOSURE OF THE INVENTION

In accordance with the present invention, there is disclosed a movable wall system particularly suitable for athletic courts including support structure disposed opposite from a stationary wall, a movable wall assembly opposite and spaced a selected distance from the stationary wall, extensible and retractable connecting means connected between the support structure and the wall assembly which stabilizes the wall assembly during movement, roller means to facilitate sliding movement of the wall assembly and means to hold the wall assembly in selected positions relative to the stationary wall.

BRIEF DESCRIPTION OF THE DRAWINGS

Details of this invention are described in connection with the accompanying drawings which like parts bear similar reference numerals in which.

DETAILED DESCRIPTION

Figure 1:
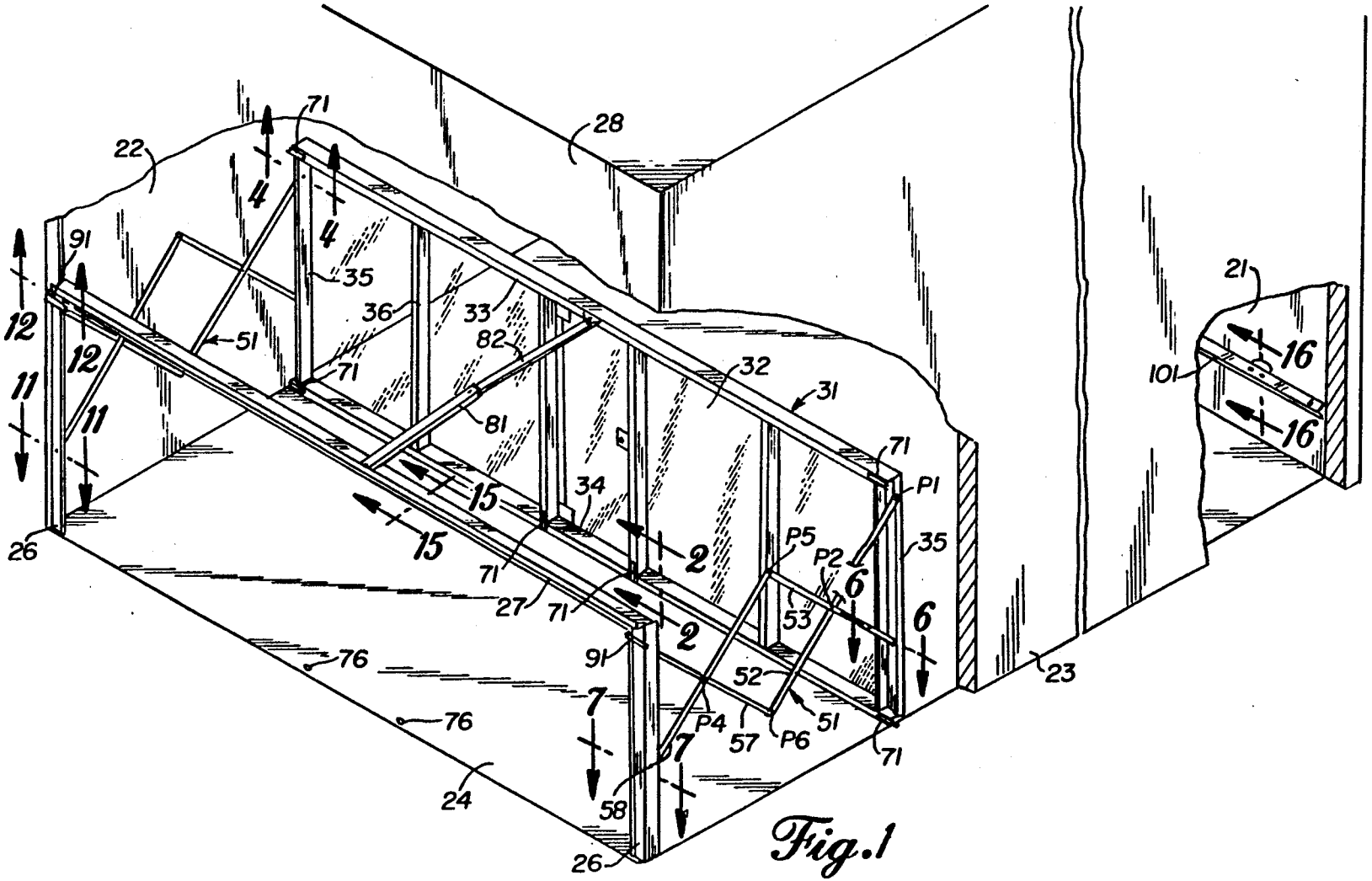
FIG. 1 is a perspective view of a movable wall system embodying features of the present invention shown in a forward extended position suitable for playing squash in an athletic court with wall portions broken away to show interior parts.
Figure 2:
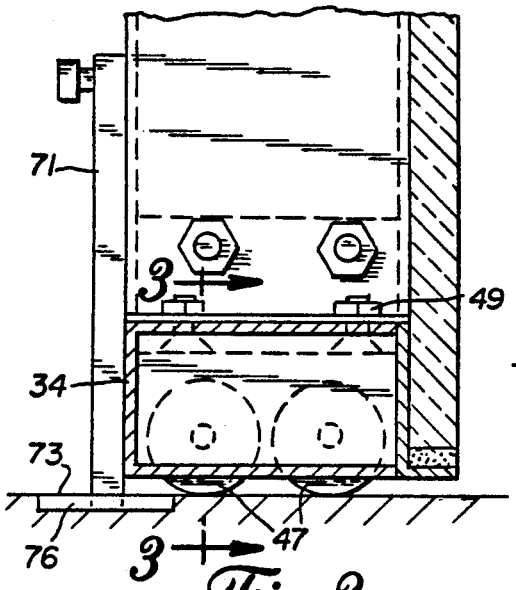
FIG. 2 is a sectional view taken along line 2—2 of FIG. 1 showing bottom rollers engaging the floor and a bottom slide bolt catch in the locked position.
Figure 3:
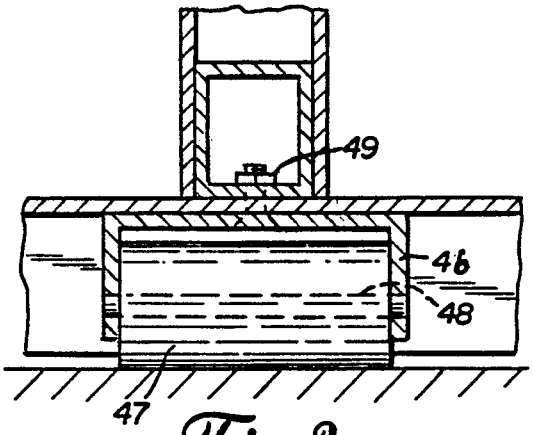
FIG. 3 is a sectional view taken along line 3—3 of FIG. 2.
Figure 5:
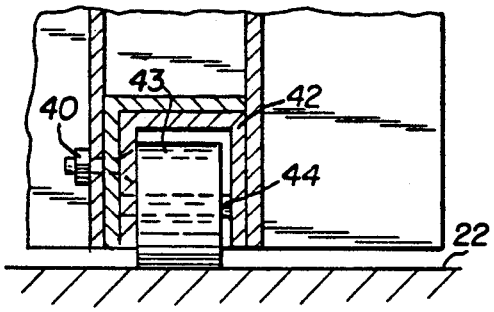
FIG. 5 is a sectional view taken along line 5—5 of FIG. 4.
Figure 4:
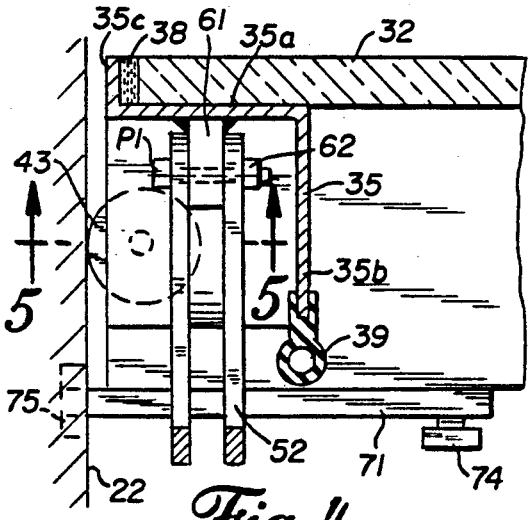
FIG. 4 is a sectional view taken along line 4—4 of FIG. 1 showing a side roller against a side wall, a side slide bolt catch in the locked position and a pivotal connection between one side linkage and one side frame member.
Figure 6:
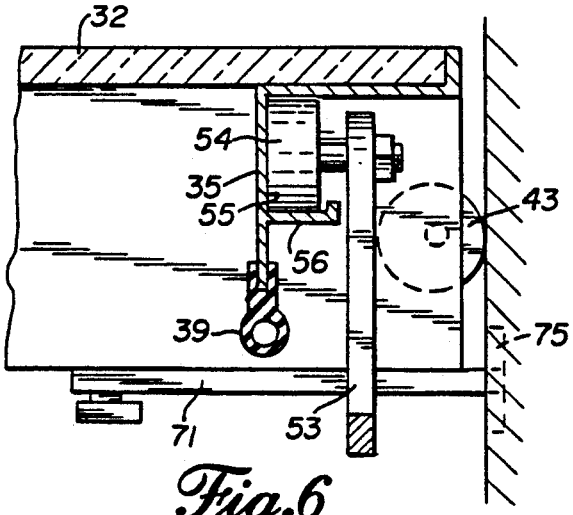
FIG. 6 is a sectional view taken along line 6—6 of FIG. 1 showing the right side wall.
Figure 7:
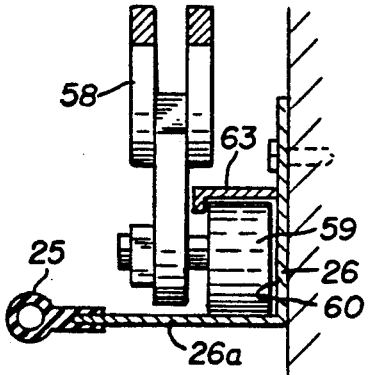
FIG. 7 is a sectional view taken along line 7—7 of FIG. 1.
Figure 8:
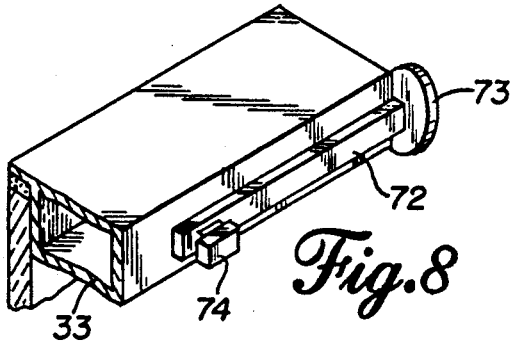
FIG. 8 is a perspective view of the top right side slide bolt catch.
Figure 10:
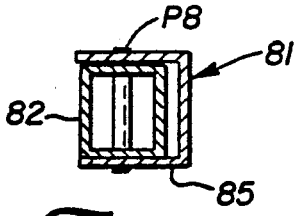
FIG. 10 is a sectional view taken along line 10—10 of FIG. 9.

Referring now to FIG. 1 there is shown an athletic court having a stationary front wall 21 with a pair of spaced left and right side walls 22 and 23, respectively, and a floor 24 and an open rear support structure opposite the front wall 21 including a pair of laterally spaced upright side support members 26 fastened to associated side walls 22 and 23 and a top support member 27 connected between the tops of side support members 26.

A movable wall assembly 31 is shown disposed at a forward extended position which includes a flat sheet 32 of transparent material such as glass mounted in a rigid wall frame which includes a top frame member 33, a bottom frame member 34, a pair of spaced, upright side frame members 35 and a plurality of intermediate frame members 36 disposed at spaced intervals with members 35 and 36 being connected at the ends between the top and bottom frame members 33 and 34.

Figure 11:
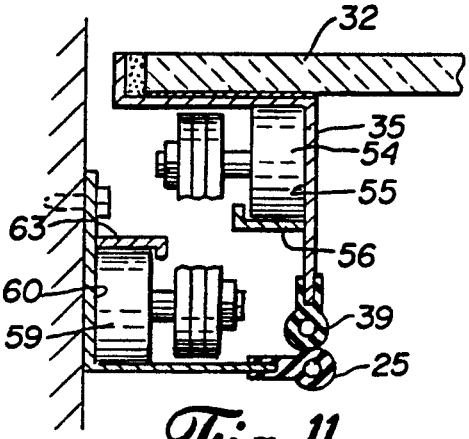
FIG. 11 is a sectional view taken along line 11—11 of FIG. 1 as it would appear with the wall assembly in the retracted position.

Each side frame member 35 has a generally right angle cross section with a front leg 35*a* that extends along the back of the glass and a rear leg 35*b* that extends rearwardly from the inside edge of the front leg. A front flange 35*c* extends forwardly of the outside edge of the front leg to provide an edge support for the glass sheet 32. A layer of silicone 38 is provided between the edge of the glass sheet 32 and the front flange. A rubber cushion member 39 fits over the rear edge rear leg 35*b* to form a resilient bumper. A rubber cushion member 25 fits over the inside edge of side support member 26 and abuts against cushion member 39 in the back retracted position as seen in FIG. 11.

A side roller assembly is mounted in the sides of wall assembly 31 at each side at both the top and bottom. Each side roller assembly has a roller 43 projecting beyond the side wall that rolls against an associated of the court side walls for sliding movement with respect to the side walls. Each side roller assembly has a C-shaped roller-supporting bracket 42 mounted within and fastened to the side member 35 by fasteners 40, a single roller 43 on a shaft 44 supported by the bracket 42 for rotation of the roller 43 about a vertical axis.

A bottom roller assembly is mounted at spaced intervals of selected distances in intermediate positions in the bottom frame member 34 to support a set of bottom rollers 47. Each bottom roller assembly includes an inverted C-shaped bracket 46 with a pair of rollers 47 mounted on an associated shaft 48 carried by the bracket 46. The bracket 46 is fastened to the bottom of the frame by fasteners 49.

Figure 15:
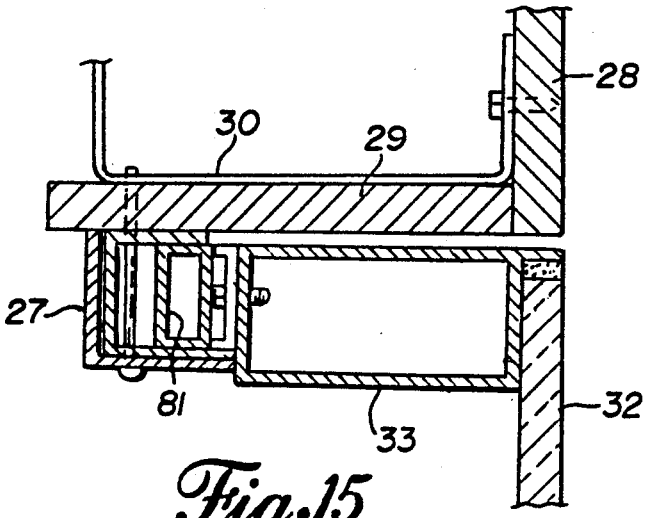
FIG. 15 is a sectional view taken along line 15—15 of FIG. 1.

As seen in FIG. 15, typically a back wall 28 of the court is cut away to form a back opening and an overhanging wall section 29 extends rearwardly from back wall 28 with top support member 27 extending under wall section 29. A header 30 extends above wall section 29 and rearwardly of back wall 28. In the back retracted position the wall assembly is arranged so that glass sheet 32 is flush with back wall 28.

A pair of identical side linkage assemblies 51 are connected between the side support members 26 and the wall assembly 31 to provide for stabilized movement of the wall assembly 31 between retracted and extended positions between the front wall 21 and the rear support members 26 and 27. Each side linkage assembly 51 has a first front link arm 52 pivotally connected to an upper portion of a side frame member 35 at pivot P1 and a second front link arm 53 with a roller 54 at the end that slides up and down in a front channel 55 at a lower position. The front channel 55 is formed by providing a leg 56 with an inturned flange that is opposite and spaced from leg **35*a* of member 35. In the extended position shown the front link arms 52 and 53 intersect and extend transverse to one another and are pivotally connected intermediate the ends at pivot P2. In the retracted position the front link arms 52 and 53** are side by side and almost parallel to one another.

A first rear link arm 57 is pivotally connected to an upper portion of the rear side support member 26 at pivot P3 and a second rear link arm 58 with a roller 59 mounted on the bottom end that slides up and down and a rear channel 60 in a lower portion of side support member 26. The rear channel 60 is formed by providing a leg 63 with an inturned flange opposite and spaced from the inturned leg **26*a* of member 26. The rear link arms 57 and 58 intersect and extend transverse to one another and are pivotally connected intermediate the ends at pivot P4. In the retracted position the rear link arms 57 and 58 are side by side and almost parallel to one another and to front link arms 52 and 53. The front and rear sets of link arms 52, 53, 57 and 58 are pivotally connected at adjacent ends at an upper pivot P5 and lower pivot P6, respectively, to provide a dual link arm arrangement. This side linkage arrangement 51 provides both stability against tilting and folds up to fit in a relatively short space within the thickness of the back wall 28 which typically is on the order of 6.5 inches. Link arms 52 and 58 are made as two parallel spaced arm members and link arms 53 and 57** are made as a single arm member.

In particular, the top front pivotal connection P1 is provided by a lug 61 affixed to leg **35*a* as by welding with the two link arm members of link arm 52 fitted outside the lug 61 and a bolt and nut fastener 62 extending through aligned holes in the link arm members and lug 61 to form the pivot P1. The top rear pivot connection P3 is provided by a pair of spaced lugs 65 and 66 affixed to leg 26*a* of the rear side support member 26 as by welding and extending forwardly therefrom with the single link arm member of link arm 57 extending between the lugs 65 and 66 and a bolt and nut fastener 67 extending through aligned holes in the link arm 57 and lugs 65 and 66**.

A plurality of slide bolt catches 71 are mounted to the wall assembly 31. In particular, there is a catch 71 mounted at each corner to engage the side wall and two on the bottom to engage the floor. Each slide bolt catch 71 has a slidable bolt body section 72 slidably fastened to the support surface with a disk 73 affixed to the end of the body section 72. The slidable body section 72 is held to a base portion by a T section or the like for guided movement in a conventional manner. A handle 74 is on the slidable bolt body section 72 and engaged to move to slide the bolt body section between an extended locking position and a retracted release position. The disk 73 fits in a hole 75 in an associated of the side wall 22 or 23 or hole 76 in the floor 24 in the extended locking or holding position.

Figure 9:
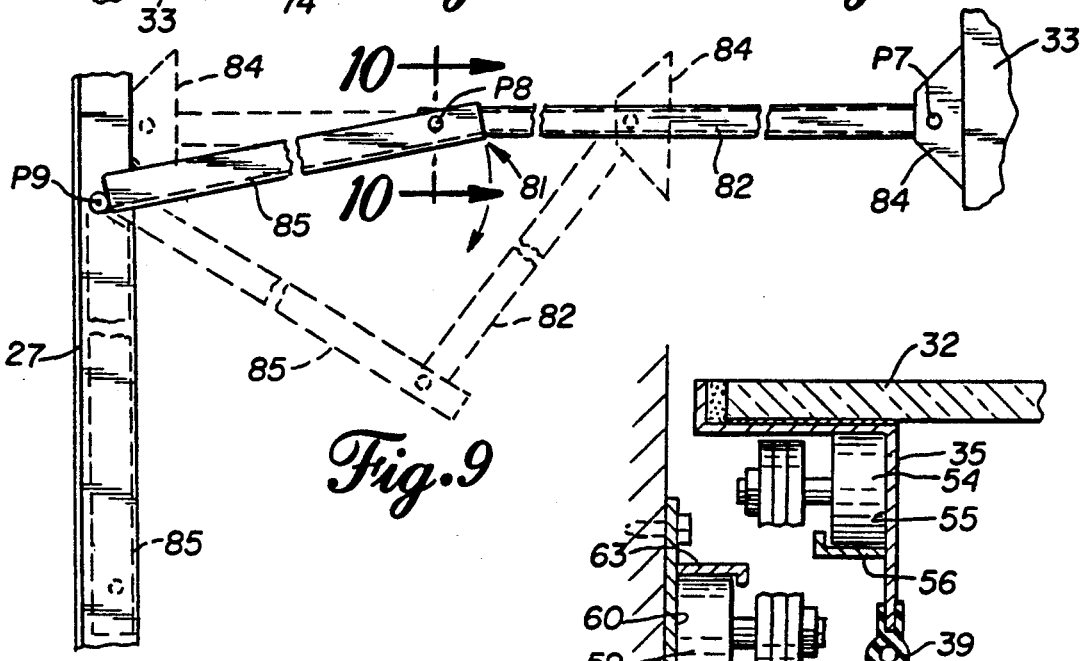
FIG. 9 is a top plan view of the top brace with an intermediate and a retracted position shown in dashed lines.

A top brace assembly 81 connects between the rear top support member 27 and the top frame member 33 to brace the wall assembly 31 in the extended position. The top brace assembly 81 has a tubular front brace section 82 that is pivotally fastened to the top frame member 33 at a pivot P7 by a pivot member in a U-shaped bracket 84 affixed to member 33. The rear end of front brace section 82 extends into a U-shaped rear brace section 85 open along one side and is pivotally connected to the front brace section 82 at a pivot P8. The rear end of the rear brace section 85 is offset to one side and pivotally connected to the top front member at pivot P9. This brace assembly 81 is rigid in the extended position and collapses to a folded up position with the front brace section 82 in the rear brace section 85 as shown in FIG. 15 and in dashed lines in FIG. 9.

A latching mechanism 91 is mounted at the top on each of the side support members 26 to hold or latch the wall assembly 31 to the back support structure including member 26 in the retracted position. Each latching mechanism 91 includes a base lug 92 mounted to an inwardly extending leg **26*a* of rear side support member 26 by fasteners 90. An L-shaped lever arm 93 is pivotally mounted at one end to the lug 92 at pivot P11 and a latch arm 94 is pivotally connected to the latch arm at the knee of the lever at pivot P10 spaced from pivot P11. The latch arm 94 is bifurcated dividing into forked arms 95 and 96 and is provided with a hook 97 at the free end. When the lever arm 93 is pivoted clockwise to the up position as shown in full lines, the hook 97 extends through a hole 99 in the leg 35*b* of the front side frame member 35. When the lever is rotated counterclockwise about pivot P11 and past center the hook is free to move out of the hole to release the wall assembly 31** as is shown in dashed lines.

Figure 12:
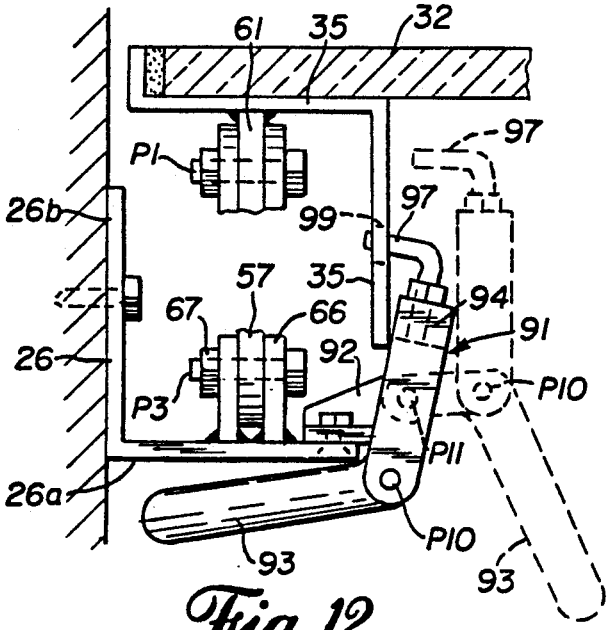
FIG. 12 is a sectional view taken along line 12—12 of FIG. 1 as it would appear with the wall in the back retracted position and the latch closed with an open position shown in dashed lines.
Figure 13:
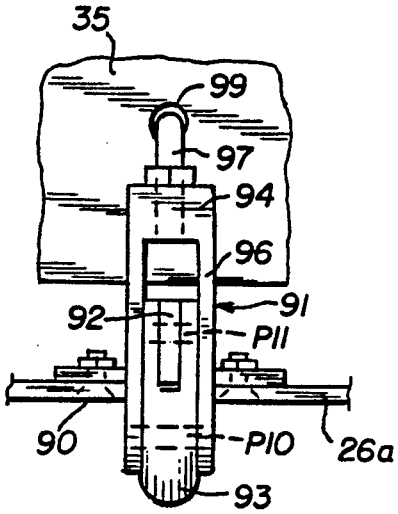
FIG. 13 is an end elevational view of a portion of FIG. 12.

In use, if it is desired to play squash, the latching mechanisms 91 and bolt catches 71 are moved to retracted release positions and the wall assembly 31 is moved to the extended position shown. If it is desired to play racquetball, the latch mechanisms 91 are released and the wall assembly 31 is pushed to be recessed within the back frame structure and the latching members 91 are attached as shown in FIGS. 12 and 13.

Figure 16:
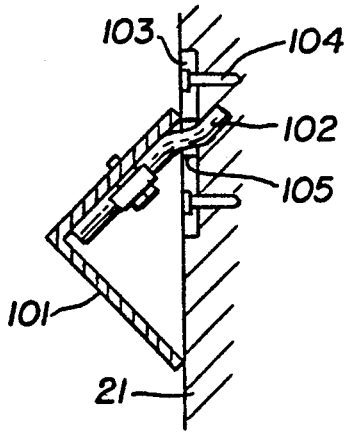
FIG. 16 is a sectional view taken along line 16—16 of FIG. 1.
Figure 14:
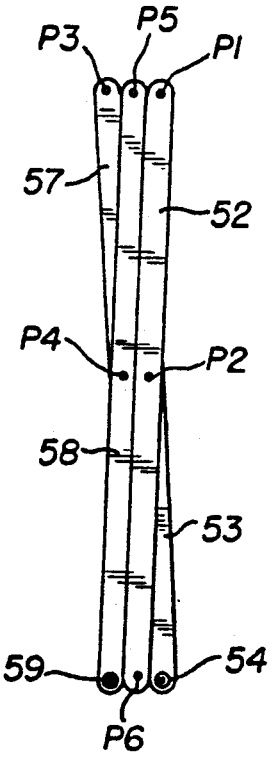
FIG. 14 is a side elevational view showing a side linkage in a retracted position.
Figure 17:
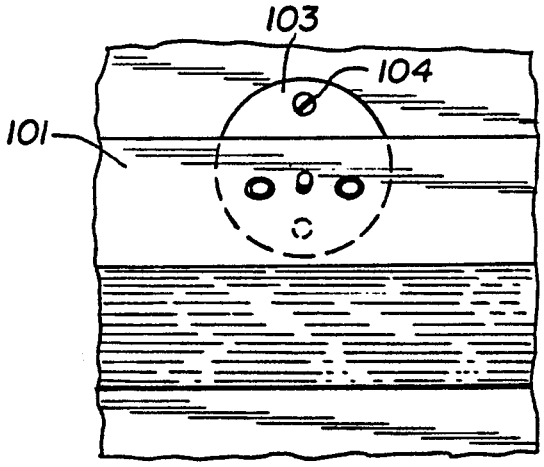
FIG. 17 is a front elevational view of a portion of FIG. 16.

Referring now to FIGS. 16 and 17 there is shown a signal device to indicate whether the ball hits along a line on the front wall 21 during a squash game. This signal device comprises an elongated angle member 101 that removably fastens to the front wall 21. This fastener includes a curved rod 102 similar to a peg board rod fastened to the angle member 101 as by a bolt. A circular disk 103 is recessed in the front wall 21 and held by screws 104. A center hole 105 in the disk 103 receives the curved rod 102. Preferably, the angle member 101 is made in two ten foot sections and there are four rod and disk assemblies. This angle member 101 makes a noise when hit by the ball and can be readily removed when racquetball or handball is played.

Although the present invention has been described with a certain degree of particularity, it is understood that the present disclosure has been made by way of example and that changes in details of structure may be made without departing from the spirit thereof.

What is claimed is:

1. A movable wall system for use with a pair of opposed side walls and a floor and in combination with a support means opposite and spaced from a wall comprising:

movable wall means having side and bottom rollers to slide the wall means along the side walls and floor, respectively, and between said support means and wall, extensible and retractable connecting means between the support means and wall means for stabilizing the wall means during movement to change the distance between said movable wall means and said wall, and means for holding said wall means against movement in selected positions with respect to said wall.

2. A movable wall system as set forth in claim 1 wherein said movable wall means includes a rigid wall frame including a top frame member, bottom frame member and upright side and intermediate frame members connected at the ends between said top and bottom frame members and a transparent sheet supported by said wall frame.

3. A movable wall system as set forth in claim 1 wherein said holding means includes a device to releasably attach said movable wall means to said support means.

4. A movable wall system as set forth in claim 1 including a rigid member releasably attached to said wall to make a noise to indicate when a ball strikes said rigid member.

5. A movable wall system as set forth in claim 4 wherein said rigid member includes an angle member having a rod with a bend that inserts into a disk with a hole fastened to said wall, said rod releasably inserting into said hole.

6. A movable back wall system for use in both racquetball and squash ball courts including a front wall, side walls, a floor, support means at the back of the court, said wall system comprising:

movable wall means having side and bottom rollers to slide the wall means along the floor and side walls, and floor, respectively, extensible and retractable connecting means between said wall means and said support means for stabilizing said movable wall means to remain in an upright position during movement of said retracted and extended positions, and means for holding said wall means against movement relative to said floor and side walls in each of said positions.

7. A movable wall system comprising:

a movable wall assembly between a back wall including back support structure and front wall, said movable wall assembly including a rigid wall frame including a top frame member, bottom frame member and upright side and intermediate frame members connected at the ends between said top and bottom frame members, a sheet of transparent glass supported along one side of said frame, said wall frame having side rollers in the side frame members and bottom rollers in the bottom frame member to slide said wall assembly along said floor and side walls, a pair of side linkage assemblies connected between said movable wall assembly and said back support structure at upper and lower positions, said linkage assemblies being arranged for movement between extended and retracted positions, each said side linkage assembly having a first front link arm with an end pivotally connected to said movable wall means at an upper position, a second front linkage arm with a roller at one end that slides up and down in a channel in a lower portion of said movable wall means, a first rear link arm pivotally connected to an upper portion of said rear side support member, a second rear linkage arm with a roller at one end that slides up and down a channel in a lower portion of said rear side support member, said first and second front link arms intersect and extend transverse to one another and are pivotally connected intermediate their ends and said first and second rear link arms intersect and extend transverse to one another and pivotally connected intermediate their ends, said first and second front and rear link arms being pivotally connected at adjacent ends, said link arms extending side by side in a retracted position, a collapsible top brace connected between said top frame member and said back support structure, said top brace including a front brace section pivotally connected at a front end to said top frame member and pivotally connected at a rear end to a rear brace section, said rear brace section being pivotally connected at a rear end to said back support structure, said rear brace section nesting in said front brace section in said collapsed position, side and bottom slide bolt catches on said movable wall assembly having end members arranged to insert into associated holes in said side walls and floor to hold said wall means against movement in selected positions with respect to said front wall, and a latching mechanism at the top and on each side of said movable wall assembly, each latch assembly including a lever arm with a hook that moves into a hole in the side support member, said lever pivoting between a locking and an unlocking position to hold said wall assembly to said rear wall.

8. A movable wall system as set forth in claim 7 wherein said side linkage assemblies collapse within the thickness of said rear wall in the retracted position and said sheet is flush with the front surface of said back wall.

9. A movable wall system for use in combination with a support means opposite and spaced from a wall and between a pair of opposed side walls comprising:

movable wall means between said support means and wall, connecting means between the support means and wall means for stabilizing the wall means during movement to change the distance between said movable wall means and said wall, and means for holding said wall means against movement in selected positions with respect to said wall, said support means including a pair of spaced, side support members secured to said pair of opposed side walls, each said side support member having a right angle shape with a first leg extending along an associated side wall and a second leg extending toward the opposite side support member.

10. A movable wall system as set forth in claim 9 wherein said support means includes a horizontal top support member extending across and connected at the top ends of said side support members.

11. A movable wall system as set forth in claim 9 wherein said connecting means includes a pair of side linkage assemblies with links that are substantially parallel in the retracted position and wherein said movable wall means has a pair of opposed side frame members, each side frame member having a first leg extending along said wall means and a second leg extending away from said wall means, opposed of said side support members and side frame members substantially containing said side linkage assemblies in said retracted position.

12. A movable wall system for use in combination with a support means having a rear side support member opposite and spaced from a wall comprising:

movable wall means between said support means and wall, connecting means between the support means and wall means for stabilizing the wall means during movement to change the distance between said movable wall means and said wall, and means for holding said wall means against movement in selected positions with respect to said wall, said connecting means including a pair of side linkage assemblies connected at upper and lower portions of said wall means and arranged for movement between retracted and extended positions, each of said side linkage assemblies having a first front link arm with an end pivotally connected to said movable wall means at a fixed pivot held against movement vertically along said movable wall means, a second front linkage arm with a roller at one end that slides up and down in a channel in a lower portion of said movable wall means, a first rear link arm pivotally connected to said rear side support member, a second rear linkage arm with a roller at one end that slides up and down in a channel in a lower portion of said rear side support member.

13. A movable wall system as set forth in claim 12 wherein said first and second front link arms intersect and extend transverse to one another and are pivotally connected intermediate their ends and said first and second rear link arms intersect and extend transverse to one another and pivotally connected intermediate their ends, said first and second front and rear link arms being pivotally connected at adjacent ends, said link arms extending side by side in said retracted position.

14. A movable wall system for use with a pair of opposed side walls and a floor and in combination with a support means opposite and spaced from a wall comprising:

movable wall means between said support means and wall, said movable wall means having a side roller means recessed in the sides of said wall means and bottom roller means recessed in the bottom of said movable wall means, said side and bottom roller means arranged to slide against said side walls and floor, respectively, connecting means between the support means and wall means for stabilizing the wall means during movement to change the distance between said movable wall means and said wall, and means for holding said wall means against movement in selected positions with respect to said wall.

15. A movable wall system as set forth in claim 14 wherein said bottom roller means includes a set of rollers.

16. A movable wall system for use in combination with a support means opposite and spaced from a wall comprising:

movable wall means between said support means and wall, connecting means between the support means and wall means for stabilizing the wall means during movement to change the distance between said movable wall means and said wall, means for holding said wall means against movement in selected positions with respect to said wall, and a collapsible top brace extending between a top portion of said movable wall means and a top portion of said support means that holds the wall means in the extended position and collapses to a collapsed position in the retracted position.

17. A movable wall system as set forth in claim 16 wherein said collapsible top brace includes a front brace section pivotally connected at a front end to said top frame member and pivotally connected at a rear end to a rear brace section, said rear brace section being pivotally connected at a rear end to said back support structure, said rear brace section resting in said front brace section in said collapsed position, said front end connection being laterally offset from said rear end connection.

18. A movable wall system for use in combination with a support means opposite and spaced from a wall comprising:

movable wall means between said support means and wall, connecting means between the support means and wall means for stabilizing the wall means during movement to change the distance between said movable wall means and said wall, and means for holding said wall means against movement in selected positions with respect to said wall, said holding means including a plurality of slide bolt catches mounted in the sides and bottom of the wall means that slide into associated holes in the side walls and floor.

19. A movable wall system for use in combination with a support means opposite and spaced from a wall comprising:

movable wall means between said support means and wall, connecting means between the support means and wall means for stabilizing the wall means during movement to change the distance between said movable wall means and said wall, and means for holding said wall means against movement in selected positions with respect to said wall, said means for holding including a device to releasably attach said movable wall means to said support means, said device being a latching mechanism at the top and on each side of said wall means, said latch mechanism including an L-shaped lever arm pivotally mounted, a side support member secured to a side wall to pivot between a latched and an unlatched position, said lever arm having a hook pivotally attached to said lever arm whereby said hook is hooked to said wall means in the latched position and released from said wall means in an unlatched position.

* * * * *